US012714176B2

(12) United States Patent
Wikner et al.

(10) Patent No.: US 12,714,176 B2
(45) Date of Patent: Aug. 25, 2026

(54) SHELL, KIT, HELMET AND METHODS OF MANUFACTURE OF A SHELL

(71) Applicant: MIPS AB, Täby (SE)

(72) Inventors: Jakob Wikner, Täby (SE); Amy Louise Pomering, Täby (SE)

(73) Assignee: MIPS AB, Täby (SE)

( * ) Notice: Subject to any disclaimer, the term of this patent is extended or adjusted under 35 U.S.C. 154(b) by 67 days.

(21) Appl. No.: 18/289,762

(22) PCT Filed: May 25, 2022

(86) PCT No.: PCT/EP2022/064323
§ 371 (c)(1),
(2) Date: Nov. 7, 2023

(87) PCT Pub. No.: WO2022/248617
PCT Pub. Date: Dec. 1, 2022

(65) Prior Publication Data

US 2024/0277101 A1 Aug. 22, 2024

(30) Foreign Application Priority Data

May 26, 2021 (GB) ..... 2107484

(51) Int. Cl.
*A42B 3/28* (2006.01)
*A42B 3/06* (2006.01)
(Continued)

(52) U.S. Cl.
CPC ..... *A42B 3/28* (2013.01); *A42B 3/06* (2013.01); *A42B 3/00* (2013.01); *A42B 3/003* (2013.01);
(Continued)

(58) Field of Classification Search
CPC .... A42B 3/06; A42B 3/28; A42B 3/00; A42B 3/12; A42B 3/125; A42B 3/10;
(Continued)

(56) References Cited

U.S. PATENT DOCUMENTS 4,307,471 A 12/1981 Lovell
8,166,573 B1 5/2012 Chung et al.
(Continued)

FOREIGN PATENT DOCUMENTS

CN 107847003 A 3/2018
CN 207803564 U 9/2018
(Continued)

OTHER PUBLICATIONS

First Notification of Chinese Office Action and Search Report for Application No. 202280037920.3, dated Sep. 10, 2025. (16 pages including translation).

*Primary Examiner* — Khaled Annis
*Assistant Examiner* — Dakota Marin
(74) *Attorney, Agent, or Firm* — Husch Blackwell LLP

(57) ABSTRACT

A shell configured to be detachably attached to the outside of a helmet hard shell, the shell comprising: a first region; a second region; and a plurality of openings, each of the plurality of openings extending from a first side to a second side of the shell; wherein the plurality of openings are arranged along a boundary between the first region and the second region.

16 Claims, 7 Drawing Sheets

(51) Int. Cl.

| | |
|---|---|
| *A42B 3/00* | (2006.01) |
| *A42B 3/10* | (2006.01) |
| *A42B 3/12* | (2006.01) |
| *A42B 3/32* | (2006.01) |

(52) U.S. Cl.
CPC ..... *A42B 3/063* (2013.01); *A42B 3/069* (2013.01); *A42B 3/10* (2013.01); *A42B 3/12* (2013.01); *A42B 3/125* (2013.01); *A42B 3/127* (2013.01); *A42B 3/324* (2013.01)

(58) Field of Classification Search
CPC ..... A42B 3/127; A42B 3/324; A42B 3/003; A42B 3/063; A42B 3/069
USPC ..... 2/410, 411
See application file for complete search history.

(56) References Cited

U.S. PATENT DOCUMENTS

| | | | | |
|---|---|---|---|---|
| 9,706,806 | B2 | 7/2017 | Van Waes | |
| 10,271,602 | B2 * | 4/2019 | Halldin | A42B 3/064 |
| 10,624,403 | B2 * | 4/2020 | Seela | A42B 1/24 |
| 2003/0140400 | A1 * | 7/2003 | Ho | A42B 3/063 2/412 |
| 2005/0257312 | A1 | 11/2005 | Puchalski | |
| 2007/0056081 | A1 * | 3/2007 | Aspray | A42B 3/067 2/411 |
| 2007/0209098 | A1 * | 9/2007 | Peart | A42B 3/124 2/410 |
| 2011/0107503 | A1 * | 5/2011 | Morgan | A42B 3/124 2/456 |
| 2011/0307997 | A1 * | 12/2011 | Blair | A42B 3/128 2/414 |
| 2012/0047635 | A1 | 3/2012 | Finiel et al. | |
| 2014/0090154 | A1 | 4/2014 | Vito | |
| 2014/0223641 | A1 * | 8/2014 | Henderson | A42B 3/065 2/411 |
| 2015/0164174 | A1 | 6/2015 | West | |
| 2016/0021965 | A1 * | 1/2016 | Mayerovitch | A42B 3/064 2/414 |
| 2016/0029731 | A1 * | 2/2016 | Magee | A42B 3/003 2/412 |
| 2019/0015238 | A1 * | 1/2019 | Mottram | A61F 5/05891 |
| 2019/0328074 | A1 | 10/2019 | Pomering et al. | |
| 2023/0109117 | A1 * | 4/2023 | Pietrzak | F16F 7/12 24/482 |

FOREIGN PATENT DOCUMENTS

| | | | |
|---|---|---|---|
| CN | 110678094 | A | 1/2020 |
| CN | 111511239 | A | 8/2020 |
| CN | 212994757 | U | 4/2021 |
| EP | 0790787 | A1 | 8/1997 |
| JP | 2001055616 | A | 2/2001 |
| JP | 2003027322 | A | 1/2003 |
| JP | 2013529263 | A | 7/2013 |
| TW | 201826957 | A | 8/2018 |
| WO | 2001/045526 | A1 | 6/2001 |
| WO | 2011/139224 | A1 | 11/2011 |
| WO | 2017/148958 | A1 | 9/2017 |
| WO | 2018108940 | A1 | 6/2018 |
| WO | 2018211106 | A1 | 11/2018 |
| WO | 2020/115063 | A1 | 6/2020 |
| WO | 2020260185 | A1 | 12/2020 |
| WO | 2021026171 | A1 | 2/2021 |

* cited by examiner

SHELL, KIT, HELMET AND METHODS OF MANUFACTURE OF A SHELL

RELATED APPLICATIONS

This application is a 35 USC § 371 National Stage application of International Application No. PCT/EP2022/064323, entitled "SHELL, KIT, HELMET AND METHODS OF MANUFACTURE OF A SHELL," filed on May 25, 2022, which claims the benefit of United Kingdom Patent Application No. 2107484.4, filed May 26, 2021, which are hereby incorporated by reference herein in their entirety.

TECHNICAL FIELD

The present invention relates to a shell, a kit comprising a shell and a helmet, a helmet and methods of manufacture of a shell.

BACKGROUND ART

Impact protection apparatuses generally aim to reduce the energy transferred to an object, such as a person to be protected, by an impact. This may be achieved by energy absorbing means, energy redirecting means, or a combination thereof. Energy absorbing means may include energy absorbing materials, such as a foam materials, or structures configured to deform elastically and/or plastically in response to an impact. Energy redirecting means may include structures configured to slide, shear or otherwise move in response to an impact.

Impact protection apparatuses include protective apparel for protecting a wearer of the apparel. Protective apparel comprising energy absorbing means and/or energy redirecting means is known. For example, such means are implemented extensively in protective headgear, such as helmets.

Examples of helmets comprising energy absorbing means and energy redirecting means include WO 2001/045526 and WO 2011/139224 (the entirety of which are herein incorporated by reference). Specifically, these helmets include at least one layer formed from an energy absorbing material and at least one layer that can move relative to the head of the wearer of the helmet under an impact.

Implementing moving parts in a helmet/an apparatus has challenges. For example, ensuring that friction between moving parts under an impact can be overcome to allow enough relative movement between parts can be challenging. Ensuring that the apparatus can be manufactured and assembled relatively easily can be challenging.

It is the aim of the present invention to provide a shell, a kit comprising a shell and a helmet, a helmet and methods of manufacture of a shell that at least partially addresses some of the problems discussed above.

STATEMENTS OF THE INVENTION

According to an aspect of the present invention, there is provided a shell configured to be detachably attached to the outside of a helmet hard shell, the shell comprising: a first region: a second region; and a plurality of openings, each of the plurality of openings extending from a first side to a second side of the shell; wherein the plurality of openings are arranged along a boundary between the first region and the second region.

In an arrangement, the plurality of openings are arranged around a perimeter of the second region such that the plurality of openings enclose the second region.

In an arrangement, each of the plurality of openings is longer in a direction along the boundary than in a direction perpendicular to the boundary.

In an arrangement, the plurality of openings define a plurality of connecting portions between the first region and the second region; and the sum of the lengths of each of the plurality of openings along the boundary is greater than the sum of the lengths of each of the connecting portions along the boundary.

In an arrangement, the second region is arranged in a side region, a front region or a back region of the shell.

In an arrangement, the shell further comprises: a third region; and a further plurality of openings, each of the further plurality of openings extending from the first side to the second side of the shell; wherein the plurality of openings are arranged along a boundary between the first region and the third region.

In an arrangement, the shell is from 0.5 mm to 2.5 mm thick, preferably from 1 mm to 1.5 mm thick.

In an arrangement, the shell further comprises at least one connector for connecting the shell to the helmet.

In an arrangement, said connector is provided on the lower edge of the shell.

According to an aspect of the present invention, there is provided a kit comprising a shell as described in any of the previous arrangements and a helmet; wherein the shell is configured to be attached to the helmet.

According to an aspect of the present invention, there is provided a helmet comprising a helmet hard shell and the shell as described in any previous arrangement, wherein the shell is arranged outwards of the hard shell.

In an arrangement, the shell is detachably attached to an edge of the helmet hard shell.

In an arrangement, the edge is the bottom edge of the helmet hard shell.

In an arrangement, the shape of the shell conforms to the shape of an outer surface of the helmet hard shell.

In an arrangement, the rigidity of the material forming the helmet hard shell is lower than the material forming the shell.

In an arrangement, the rigidity of the material forming the helmet hard shell is higher than the material forming the shell.

In an arrangement, a sliding interface is provided between the shell and the helmet hard shell.

In an arrangement, the periphery of the shell is detachably connected to the periphery of the helmet hard shell by at least one of a interference connection, a push fit connection and a snap fit connection.

In an arrangement, the shell further comprises a lip portion extending over the edge of the helmet hard shell, wherein the lip portion extending over the edge of the helmet hard shell is configured to detachably attach the shell to the helmet hard shell.

In an arrangement, the lip portion extends over the edge of the helmet hard shell around the entire periphery of the helmet hard shell.

In an arrangement, the helmet hard shell comprises a recess on the outer surface of the helmet hard shell; and the second region is located within the recess.

In an arrangement, the helmet hard shell comprises a vent; and at least one of the plurality of openings and/or the second region is located over the vent.

In an arrangement, the helmet further comprises an energy absorbing layer disposed inward of the helmet hard shell.

According to an aspect of the present invention there is provided a method of manufacturing a shell according to any previous arrangement, the method comprising the steps of: forming a shell: removing material from the shell to form a plurality of openings, each of the plurality of openings extending from a first side to a second side of the shell; wherein the plurality of openings are arranged along a boundary between a first region of the shell and a second region of the shell.

According to an aspect of the present invention there is provided a method of manufacturing a shell according to any previous arrangement, the method comprising the steps of: integrally forming a shell, the shell comprising: a first region; a second region; and a plurality of openings, each of the plurality of openings extending from a first side to a second side of the shell: wherein the plurality of openings are arranged along a boundary between the first region and the second region.

BRIEF DESCRIPTION OF THE DRAWINGS

The invention is described in detail below, with reference to the accompanying figures, in which.

DETAILED DESCRIPTION

It should be noted that the Figures are schematic, the proportions of the thicknesses of the various layers, and/or of any gaps between layers, depicted in the Figures have been exaggerated for the sake of clarity and can of course be adapted according to need and requirements.

General features of the example helmets are described below with reference to FIGS. 1 to 8.

FIGS. 1 to 6 show example helmets 1 comprising an energy absorbing layer 3. The purpose of the energy absorbing layer 3 is to absorb and dissipate energy from an impact in order to reduce the energy transmitted to the wearer of the helmet. Within the helmet 1, the energy absorbing layer may be the primary energy absorbing element. Although other elements of the helmet 1 may absorb that energy to a more limited extent, this is not their primary purpose.

The energy absorbing layer 3 may absorb energy from a radial component of an impact more efficiently than a tangential component of an impact. The term "radial" generally refers to a direction substantially toward the centre of the wearers head, e.g. substantially perpendicular to an outer surface of the helmet 1. The term "tangential" may refer to a direction substantially perpendicular to the radial direction, in a plane comprising the radial direction and the impact direction.

The energy absorbing layer may be formed from an energy absorbing material, such as a foam material. Preferable such materials include expanded polystyrene (EPS), expanded polypropylene (EPP), expanded polyurethane (EPU), vinyl nitrile foam; or strain rate sensitive foams such as those marketed under the brand-names Poron™ and D3O™.

Alternatively, or additionally, the energy absorbing layer may have a structure that provides energy absorbing characteristics. For example, the energy absorbing layer may comprise deformable elements, such as cells or finger-like projections, that deform upon impact to absorb and dissipate the energy of an impact.

Figure 6:
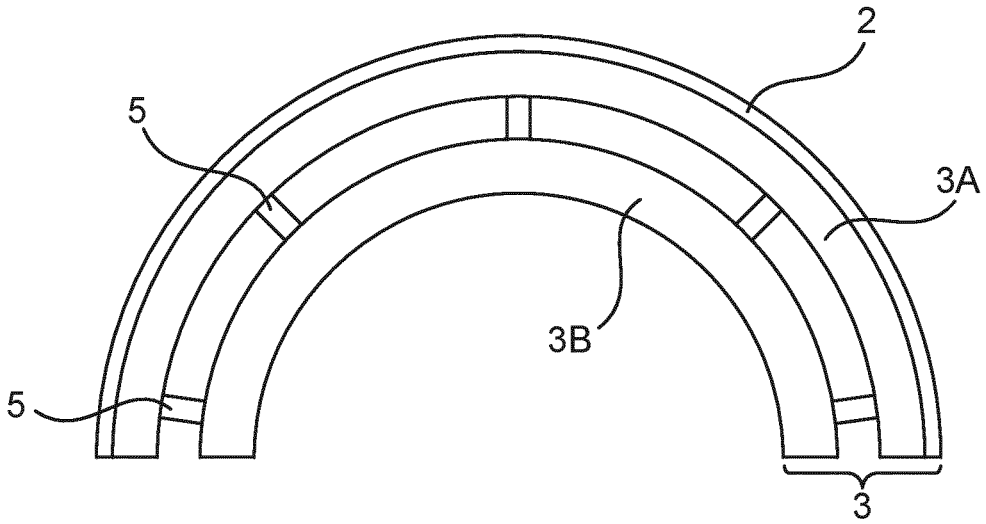
FIG. 6 schematically shows a cross-section through a sixth example helmet.

As illustrated in FIG. 6, the energy absorbing layer 3 of the helmet 1 is divided into outer and inner parts 3A, 3B.

The energy absorbing layer is not limited to one specific arrangement or material. The energy absorbing layer 3 may be provided by multiple layers having different arrangements, i.e. formed from different materials or having different structures. The energy absorbing layer 3 may be a relatively thick layer. For example, it may be thickest layer of the helmet 1.

FIGS. 1 to 7 show example helmets 1 comprising an outer layer 2. The purpose of the outer layer 2 may be to provide rigidity to the helmet. This may help spread the impact energy over a larger area of the helmet 1. The outer layer 2 may also provide protection against objects that might pierce the helmet 1. Accordingly, the outer shell may be a relatively strong and/or rigid layer, e.g. compared to an energy absorbing layer 3. The outer layer 2 may be a relatively thin layer, e.g. compared to an energy absorbing layer 3.

The outer layer 2 may be formed from a relatively strong and/or rigid material. Preferable such materials include a polymer material such as polycarbonate (PC), polyvinylchloride (PVC) or acrylonitrile butadiene styrene (ABS) for example. Advantageously, the polymer material may be fibre-reinforced, using materials such as glass-fibre, Aramid, Twaron, carbon-fibre and/or Kevlar.

In some example helmets, the outer layer 2 and/or the energy absorbing layer 3 may be adjustable in size in order to provide a customised fit. For example the outer layer 2 may be provided in separate front and back parts. The relative position of the front and back parts may be adjusted to change the size of the outer layer 2. In order to avoid gaps in the outer layer 2, the front and back parts may overlap. The energy absorbing layer 3 may also be provided in separate front and back parts. These may be arranged such that the relative position of the front and back parts may be adjusted to change the size of the energy absorbing layer 3. In order to avoid gaps in the energy absorbing layer 3, the front and back parts may overlap.

FIGS. 1 to 4 shows example helmets 1 comprising an interface layer 4. Although not shown in FIGS. 5 to 7, these example helmets may also comprise an interface layer 4. The purpose of interface layer 4 may be to provide an interface between the helmet and the wearer. In some arrangements, this may improve the comfort of the wearer. The interface layer 4 may be provided to mount the helmet on the head of a wearer. The interface layer 4 may be provided as a single part or in multiple sections.

The interface layer 4 may be configured to at least partially conform to the head of the wearer. For example, the interface layer 4 may be elasticated and/or may comprise an adjustment mechanism for adjusting the size of the interface layer 4. In an arrangement, the interface layer may engage with the top of a wearer's head. Alternatively or additionally, the interface layer 4 may comprise an adjustable band configured to encircle the wearer's head.

The interface layer 4 may comprise comfort padding 4A. Multiple sections of comfort padding 4A may be provided. The comfort padding 4A may be provided on a substrate 4B for mounting the comfort padding to the rest of the helmet 1.

The purpose of the comfort padding 4A is to improve comfort of wearing the helmet and/or to provide a better fit. The comfort padding may be formed from a relatively soft material, e.g. compared to the energy absorbing layer 3 and/or the outer layer 2. The comfort padding 4A may be formed from a foam material. However, the foam material may be of lower density and/or thinner than foam materials used for the energy absorbing layer 3. Accordingly, the comfort padding 4A will not absorb a meaningful amount of energy during an impact, i.e. for the purposes of reducing the harm to the wearer of the helmet. Comfort padding is well recognised in the art as being distinct from energy absorbing layers, even if they may be constructed from somewhat similar materials.

The interface layer 4, and/or comfort padding 4A that may be part of it, may be removable. This may enable the interface layer 4 and/or comfort passing 4A to be cleaned and/or may enable the provision of an interface layer and/or comfort padding 4A that is configured to fit a specific wearer.

Straps, e.g. chin straps, may be provided to secure the helmet 1 to the head of the wearer.

The helmets of FIGS. 1 to 4 are configured such that the interface layer 4 is able to move, for example slide, in a tangential direction relative to the energy absorbing layer 3 in response to an impact. As shown in FIGS. 1 to 4, the helmet may also comprise connectors 5 between the energy absorbing layer 3 and the interface layer 4 that allow relative movement between the energy absorbing layer 3 and the interface layer 4 while connecting the elements of the helmet together.

Figure 5:
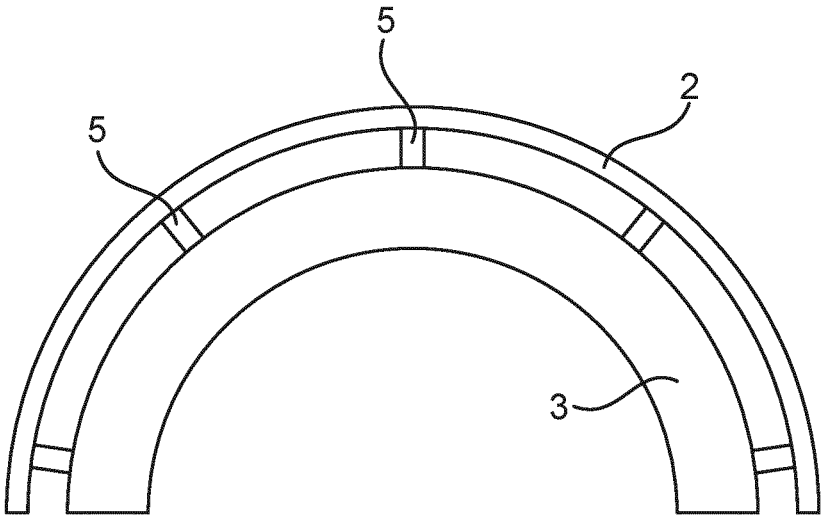
FIG. 5 schematically shows a cross-section through a fifth example helmet.

The helmet of FIG. 5 is configured such that the outer layer 2 is able to move, for example slide, in a tangential direction relative to the energy absorbing layer 3 in response to an impact. As shown in FIG. 5, the helmet 1 may also comprise connectors 5 between the energy absorbing layer 3 and the outer layer 2 that allow relative movement between the energy absorbing layer 3 and the outer layer 2 while connecting the elements of the helmet together.

The helmet of FIG. 6 is configured such that the outer part 3A of the energy absorbing layer 3 is able to move, for example slide, in a tangential direction relative to the inner part 3B of the energy absorbing layer 3 in response to an impact. As shown in FIG. 6, the helmet 1 may also comprise connectors 5 between the outer part 3A of the energy absorbing layer 3 and the inner part 3B of the energy absorbing layer 3, that allow relative movement between the outer part 3A of the energy absorbing layer 3 and the inner part 3B of the energy absorbing layer 3, while connecting the elements of the helmet together.

The purpose of helmet layers that move or slide relative to each other may be to redirect energy of an impact that would otherwise be transferred to the head the wearer. This may improve the protection afforded to the wearer against a tangential component of the impact energy. A tangential component of the impact energy would normally result in rotational acceleration of the head of the wearer. It is well know that such rotation can cause brain injury. It has been shown that helmets with layers that move relative to each other can reduce the rotational acceleration of the head of the wearer. A typical reduction may be roughly 25% but reductions as high as 90% may be possible in some instances.

Preferably, relative movement between helmet layers results in a total shift amount of at least 0.5 cm between an outermost helmet layer and an inner most helmet layer, more preferably at least 1 cm, more preferably still at least 1.5 cm. Preferably the relative movement can occur in any direction, e.g. in a circumferential direction around the helmet, left to right, front to back and any direction in between.

Regardless of how helmet layers are configured to move relative to each other, it is preferable that the relative movement, such as sliding, is able to occur under forces typical of an impact for which the helmet is designed (for example an impact that is expected to be survivable for the wearer). Such forces are significantly higher than forces that a helmet may be subject to during normal use. Impact forces tend to compress layers of the helmet together, increasing the reaction force between components and thus increasing frictional forces. Where helmets are configured to have layers sliding relative to each other the interface between them may need to be configured to enable sliding even under the effect of the high reaction forces experienced between them under an impact.

As shown in FIGS. 1 to 6, a sliding interface may be provided between the layers of the helmet 1 that are configured to slide relative to each other. At the sliding interface, surfaces slide against each other to enable relative sliding between the layers of the helmet 1. The sliding interface may be a low friction interface. Accordingly, friction reducing means may be provided at the sliding interface. Example sliding interfaces are described further below, in relation to each of the example helmets 1 shown in FIGS. 1 to 6.

The friction reducing means may be a low friction material or lubricating material. These may be provided as a continuous layer, or multiple discrete patches, or portions of material, for example.

Possible low friction materials for the friction reducing means include waxy polymers such as PC, PTFE, ABS, PVC, Nylon, PFA, FEP, PE and UHMWPE, Teflon®, a woven fabric such as Tamarack®, a non-woven fabric, such a felt. Such low friction materials may have a thickness of roughly 0.1-5 mm, but other thicknesses can also be used, depending on the material selected and the performance desired. Possible lubricating materials include oils, polymers, microspheres, or powders. Combinations of the above may be used.

In one example the low friction material or lubricating material may be a polysiloxane-containing material. In particular the material may comprise (i) an organic polymer, a polysiloxane and a surfactant: (i) an organic polymer and a copolymer based on a polysiloxane and an organic polymer: or (iii) a non-elastomeric cross-linked polymer obtained or obtainable by subjecting a polysiloxane and an organic polymer to a cross-linking reaction. Preferred options for such materials are described in WO2017148958.

In one example the low friction material or lubricating material may comprise a mixture of (i) an olefin polymer, (ii) a lubricant, and optionally one or more further agents. Preferred options for such materials are described in WO2020115063.

In one example the low friction material or lubricating material may comprise an ultra high molecular weight (UHMW) polymer having a density of ≤960 kg/m3, which UHMW polymer is preferably an olefin polymer. Preferred options for such materials are described in WO2020115063.

In one example the low friction material or lubricating material may comprise a polyketone. Preferred options for such materials are described in WO2020260185.

In some arrangements, it may be desirable to configure the low friction interface such that the static and/or dynamic coefficient of friction between materials forming sliding surfaces at the sliding interface is between 0.001 and 0.3 and/or below 0.15. The coefficient of friction can be tested by standard means, such as standard test method ASTM D1894.

The friction reducing means may be provided on or be an integral part of one or both of the layers of the helmet 1 that are configured to slide relative to each other. In some examples, helmet layers may have a dual function, including functioning as a friction reducing means. Alternatively, or additionally, the friction reducing means may be a separate from the layers of the helmet 1 that are configured to slide relative to each other, but provided between the layers.

Instead of the sliding interface, in some examples, a shearing interface may be provided between the layers of the helmet 1 that are configured to move relative to each other. At the shearing interface, a shearing layer shears to enable relative movement between the layers of the helmet 1. The shearing layer may comprise a gel or liquid, which may be retained within a flexible envelope. Alternatively, the shearing layer may comprise two opposing layers connected by deformable elements that deform to enable shearing between the two opposing layers.

A single shearing layer may be provided that substantially fills the volume between two layers of a helmet. Alternatively, one or more shearing layers may be provided that fill only a portion of the volume between two layers of a helmet, e.g. leaving substantial space around the shearing layers. The space may comprise a sliding interface, as described above. As such, helmets may have a combination of shearing and sliding interfaces. Such shearing layers may act as connectors 5, which are described further below.

FIGS. 1 to 7 schematically show connectors 5, 25. The connectors 5, 25 are configured to connect two layers of the helmet while enabling relative movement, e.g. sliding or shearing, between the layers. Different numbers of connectors 5, 25 may be provided than as shown in FIGS. 1 to 7. The connectors 5, 25 may be located at different positions than as shown in FIGS. 1 to 7, for example at a peripheral edge of the helmet 1 instead of a central portion.

Typically, a connector 5, 25 comprises first and second attachment parts respectively configured to attach to first and second parts of the helmet and a deformable part between the first and second attachment parts that enables the first and second attachment parts to move relative to each other to enable movement between the first and second parts of the helmet of the helmet. Connectors 5, 25 may absorb some impact energy by deforming.

The specific arrangements of each of the example helmets shown in FIGS. 1 to 7 are described below.

Figure 1:
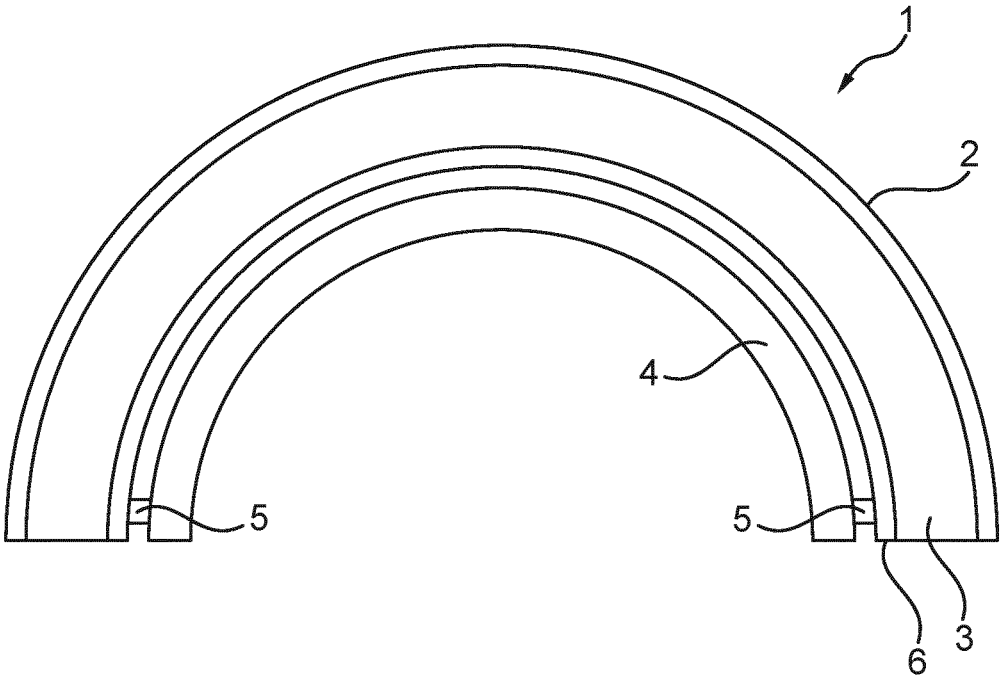
FIG. 1 schematically shows a cross-section through a first example helmet.

FIG. 1 shows a helmet comprising an outer layer 2, an energy absorbing layer 3 and an interface layer 4. The interface layer 4 is provided as a single layer and comprises comfort padding.

The helmet of FIG. 1 is configured such that the interface layer 4 is able to slide relative to the energy absorbing layer 3 in response to an impact. A sliding interface is provided between the interface layer 4 and the energy absorbing layer 3.

A sliding layer 6 is provided on a surface of the energy absorbing layer 3 facing the sliding interface. The sliding layer 6 may be moulded to the energy absorbing layer 3 or otherwise attached thereto. The sliding layer 6 may be formed from a relatively hard material, e.g. relative to the energy absorbing layer 3. The sliding layer 6 is configured to provide friction reducing means to reduce the friction at the sliding interface. This may be achieved by forming the sliding layer 6 from a low friction material, such as PC, PTFE, ABS, PVC, Nylon, PFA, FEP, PE and UHMWPE. Alternatively, or additionally, this may be achieved by applying a low friction coating to the sliding layer 6, and/or applying a lubricant to the sliding layer 6.

Alternatively or additionally, friction reducing means, to reduce the friction at the sliding interface, may be provided by forming the energy absorbing layer 3 from a low friction material, by applying a low friction coating to the energy absorbing layer 3 and/or applying a lubricant to the energy absorbing layer 3.

The helmet 1 shown in FIG. 1 also comprises connectors 5 attached to the interface layer 4. The connectors are also connected to the sliding layer 6 to allow relative sliding between the energy absorbing layer 3 and the interface layer 4. Alternatively, or additionally, one or more of the connectors 5 may be connected to another part of the remainder of the helmet 1, such as the energy absorbing layer 3 or the outer shell 2. The connectors 5 may also be connected to two or more parts of the remainder of the helmet 1.

It should be understood that such an arrangement of the energy absorbing layer 3 and the interface layer 4 may be added to any helmet described herein.

Figure 2:
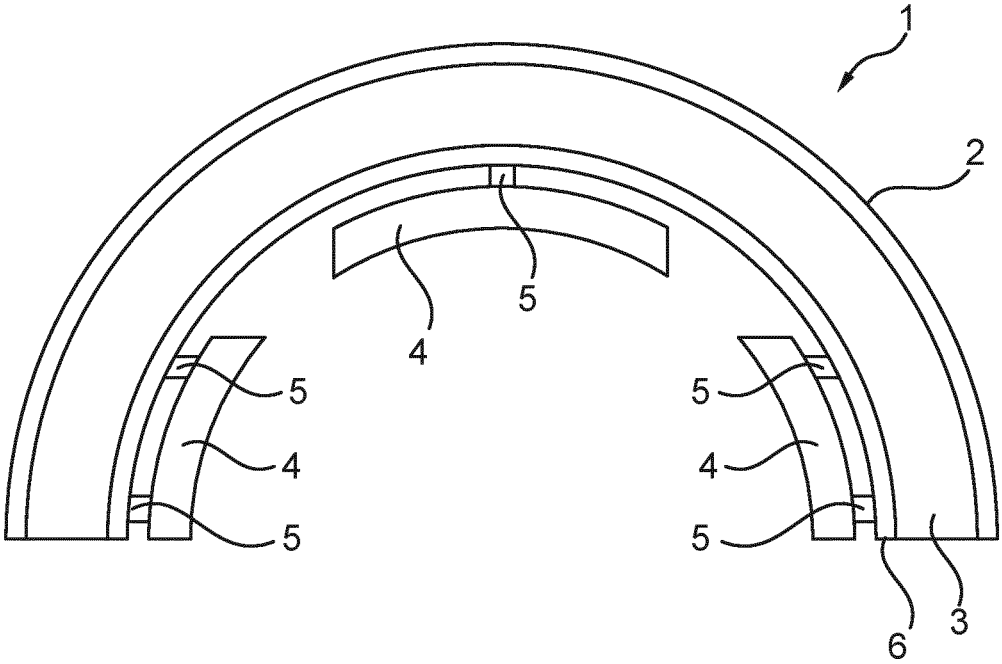
FIG. 2 schematically shows a cross-section through a second example helmet.

FIG. 2 shows a helmet comprising an outer layer 2, an energy absorbing layer 3 and an interface layer 4. The interface layer 4 is provided as a plurality of independent sections each comprising comfort padding.

The helmet of FIG. 2 is configured such that the section of the interface layer 4 are able to slide relative to the energy absorbing layer 3 in response to an impact. A sliding interface is provided between the sections of the interface layer 4 and the energy absorbing layer 3.

An sliding layer 6 is provided on a surface of the energy absorbing layer 3 facing the sliding interface. The sliding layer 6 may be moulded to the energy absorbing layer 3 or otherwise attached thereto. The sliding layer 6 may be formed from a relatively hard material, e.g. relative to the energy absorbing layer 3. The sliding layer 6 is configured to provide friction reducing means to reduce the friction at the sliding interface. This may be achieved by forming the sliding layer 6 from a low friction material, such as PC, PTFE, ABS, PVC, Nylon, PFA, FEP, PE and UHMWPE. Alternatively, or additionally, this may be achieved by applying a low friction coating to the sliding layer 6, and/or applying a lubricant to the sliding layer 6.

Alternatively or additionally, friction reducing means, to reduce the friction at the sliding interface, may be provided by forming the energy absorbing layer 3 from a low friction material, by applying a low friction coating to the energy absorbing layer 3 and/or applying a lubricant to the energy absorbing layer 3. b4 The helmet 1 shown in FIG. 2 also comprises connectors 5 attached to each independent section of the interface layer 4. The connectors 5 are also attached to the sliding layer 6 to allow relative sliding between the energy absorbing layer 3 and the sections of the interface layer 4. Alternatively or additionally, one or more of the connectors 5 may be connected to another part of the remainder of the helmet 1, such as the energy absorbing layer 3 or the outer shell 2. The connectors 5 may also be connected to two or more parts of the remainder of the helmet 1.

It should be understood that such an arrangement of the energy absorbing layer 3 and the interface layer 4 may be added to any helmet described herein.

Figure 3:
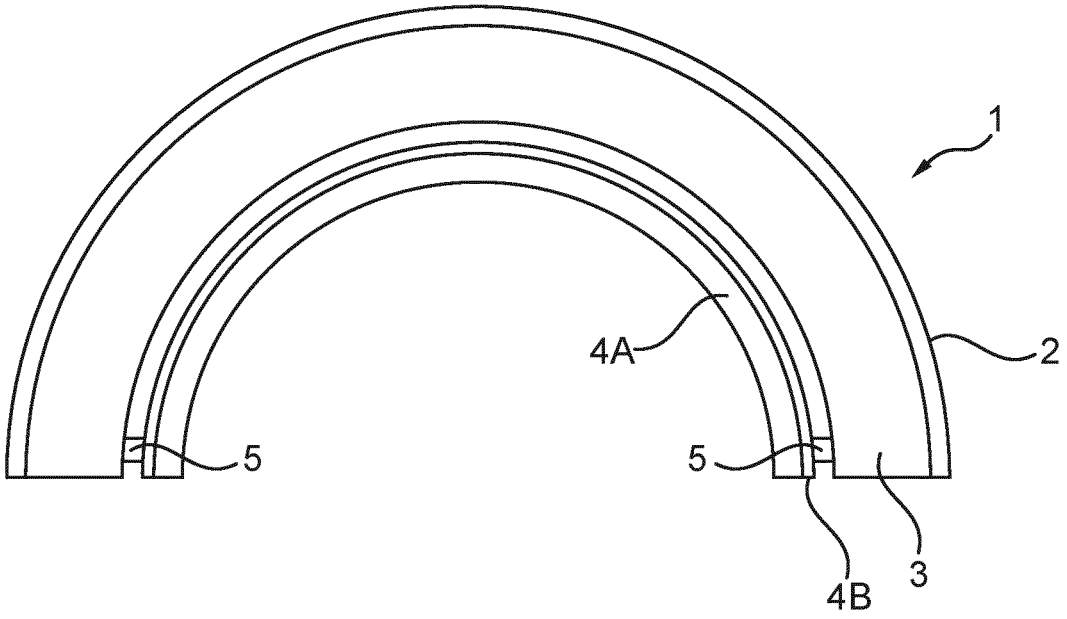
FIG. 3 schematically shows a cross-section through a third example helmet.

FIG. 3 shows a helmet comprising an outer layer 2, an energy absorbing layer 3 and an interface layer 4. The interface layer 4 is provided as a single layer and comprises comfort padding 4A attached to a substrate 4B. The substrate 4B may be bonded to the outer side of the comfort padding 4A. Such bonding could be through any means, such as by adhesive or by high frequency welding or stitching.

The helmet of FIG. 3 is configured such that the interface layer 4 is able to slide relative to the energy absorbing layer 3 in response to an impact. A sliding interface is provided between the interface layer 4 and the energy absorbing layer 3.

The substrate 4B of the interface layer 4 faces the sliding interface. The substrate 4B may be formed from a relatively hard material, e.g. relative to the energy absorbing layer 3 and/or the comfort padding 4A. The substrate 4B is configured to provide friction reducing means to reduce the friction at the sliding interface.

This may be achieved by forming the substrate 4B from a low friction material, such as PC, PTFE, ABS, PVC, Nylon, PFA, FEP, PE and UHMWPE. Alternatively, or additionally, this may be achieved by applying a low friction coating to the substrate 4B, and/or applying a lubricant to the substrate 4B. In alternative example, the substrate 4B may be formed from a fabric material, optionally coated with a low friction material.

Alternatively or additionally, friction reducing means, to reduce the friction at the sliding interface, may be provided by forming the energy absorbing layer 3 from a low friction material, by applying a low friction coating to the energy absorbing layer 3 and/or applying a lubricant to the energy absorbing layer 3.

The helmet 1 shown in FIG. 3 also comprises connectors 5 attached to the interface layer 4. The connectors are also connected to the energy absorbing layer to allow relative sliding between the energy absorbing layer 3 and the interface layer 4. Alternatively, or additionally, one or more of the connectors 5 may be connected to another part of the remainder of the helmet 1, such as the outer shell 2. The connectors 5 may also be connected to two or more parts of the remainder of the helmet 1

It should be understood that such an arrangement of the energy absorbing layer 3 and the interface layer 4 may be added to any helmet described herein.

Figure 4:
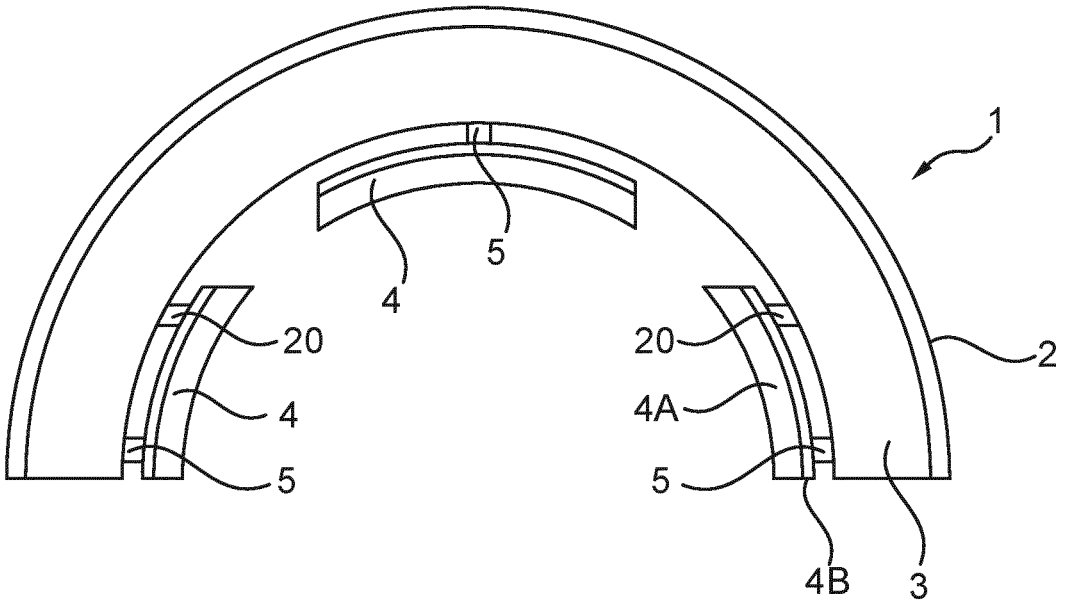
FIG. 4 schematically shows a cross-section through a fourth example helmet.

FIG. 4 shows a helmet comprising an outer layer 2, an energy absorbing layer 3 and an interface layer 4. The interface layer 4 is provided as a plurality of independent sections each comprising comfort padding 4A attached to a substrate 4B. The substrate 4B may be bonded to the outer side of the comfort padding 4A. Such bonding could be through any means, such as by adhesive or by high frequency welding or stitching.

The helmet of FIG. 4 is configured such that the interface layer 4 is able to slide relative to the energy absorbing layer 3 in response to an impact. A sliding interface is provided between the interface layer 4 and the energy absorbing layer 3.

The substrate 4B of the sections of the interface layer 4 faces the sliding interface. The substrate 4B may be formed from a relatively hard material, e.g. relative to the energy absorbing layer 3 and/or the comfort padding 4A. The substrate 4B is configured to provide friction reducing means to reduce the friction at the sliding interface.

This may be achieved by forming the substrate 4B from a low friction material, such as PC, PTFE, ABS, PVC, Nylon, PFA, FEP, PE and UHMWPE. Alternatively, or additionally, this may be achieved by applying a low friction coating to the substrate 4B, and/or applying a lubricant to the substrate 4B. In alternative example, the substrate 4B may be formed from a fabric material, optionally coated with a low friction material.

Alternatively or additionally, friction reducing means, to reduce the friction at the sliding interface, may be provided by forming the energy absorbing layer 3 from a low friction material, by applying a low friction coating to the energy absorbing layer 3 and/or applying a lubricant to the energy absorbing layer 3.

The helmet 1 shown in FIG. 4 also comprises connectors 5 attached to the sections of the interface layer 4. The connectors 5 are also connected to the energy absorbing layer 3 to allow relative sliding between the energy absorbing layer 3 and the interface layer 4. Alternatively, or additionally, one or more of the connectors 5 may be connected to another part of the remainder of the helmet 1, such as the outer shell 2. The connectors 5 may also be connected to two or more parts of the remainder of the helmet 1

It should be understood that such an arrangement of the energy absorbing layer 3 and the interface layer 4 may be added to any helmet described herein.

FIG. 5 shows a helmet comprising an outer layer 2 and an energy absorbing layer 3. Although not shown, an interface layer may additionally be provided.

The helmet of FIG. 5 is configured such that the outer layer 2 is able to slide relative to the energy absorbing layer 3 in response to an impact. A sliding interface may be provided between the outer layer 2 and the energy absorbing layer 3

Although not shown, an additional layer may be provided on a surface of the energy absorbing layer 3 facing the sliding interface. The additional layer may be moulded to the energy absorbing layer 3 or otherwise attached thereto. The additional layer may be formed from a relatively hard material, e.g. relative to the energy absorbing layer 3. The additional layer may be configured to provide friction reducing means to reduce the friction at the sliding interface.

This may be achieved by forming the additional layer from a low friction material, such as PC, PTFE, ABS, PVC, Nylon, PFA, FEP, PE and UHMWPE. Alternatively, or additionally, this may be achieved by applying a low friction coating to the additional layer and/or applying a lubricant to the additional layer.

Alternatively or additionally, friction reducing means, to reduce the friction at the sliding interface, may be provided by forming the outer layer 2 from a low friction material, providing an additional low friction layer on a surface of the outer layer 2 facing the sliding interface, by applying a low friction coating to the outer layer 2 and/or applying a lubricant to the outer layer 2.

The helmet 1 shown in FIG. 5 also comprises connectors 5 attached to the outer layer 2. The connectors 5 are also attached to the energy absorbing layer 3 (or additional layer) to allow relative sliding between the energy absorbing layer 3 and the sections of the interface layer 4. Alternatively or additionally, one or more of the connectors 5 may be connected to another part of the remainder of the helmet 1, such as an interface layer. The connectors 5 may also be connected to two or more parts of the remainder of the helmet 1.

It should be understood that such an arrangement of the outer shell 2 and the energy absorbing layer 3 may be added to any helmet described herein.

FIG. 6 shows a helmet comprising an outer layer 2 and an energy absorbing layer 3. As illustrated, the energy absorbing layer 3 of the helmet shown in FIG. 6 is divided into outer and inner parts 3A, 3B. Although not shown, an interface layer may additionally be provided.

The helmet of FIG. 6 is configured such that the outer part 3A of the energy absorbing layer 3 is able to slide relative to the inner part 3B of the energy absorbing layer 3 in response to an impact. A sliding interface may be provided between the outer part 3A of the energy absorbing layer 3 and the inner part 3B of the energy absorbing layer 3.

Although not shown, an additional layer may be provided on a surface of one or both of the inner and outer parts 3A, 3B of the energy absorbing layer 3 facing the sliding interface. The additional layer may be moulded to the inner or outer parts 3A, 3B of the energy absorbing layer 3 or otherwise attached thereto. The additional layer may be formed from a relatively hard material, e.g. relative to the energy absorbing layer 3. The additional layer may be configured to provide friction reducing means to reduce the friction at the sliding interface. This may be achieved by forming the additional layer from a low friction material, such as PC, PTFE, ABS, PVC, Nylon, PFA, EEP, PE and UHMWPE. Alternatively, or additionally, this may be achieved by applying a low friction coating to the additional layer and/or applying a lubricant to the additional layer.

Alternatively or additionally, friction reducing means, to reduce the friction at the sliding interface, may be provided by forming one or both of the inner and outer parts 3A, 3B of the energy absorbing layer 3 from a low friction material, providing an additional low friction layer on a surface of the inner and outer parts 3A, 3B of the energy absorbing layer 3 facing the sliding interface, by applying a low friction coating to the inner and outer parts 3A, 3B of the energy absorbing layer 3 and/or applying a lubricant to the inner and outer parts 3A, 3B of the energy absorbing layer 3.

The helmet 1 shown in FIG. 6 also comprises connectors 5 attached to the outer layer 2. The connectors 5 are also attached to the energy absorbing layer 3 (or additional layer) to allow relative sliding between the energy absorbing layer 3 and the sections of the interface layer 4. Alternatively or additionally, one or more of the connectors 5 may be connected to another part of the remainder of the helmet 1, such as an interface layer. The connectors 5 may also be connected to two or more parts of the remainder of the helmet 1.

It should be understood that such an arrangement of inner and outer parts 3A 3B of the energy absorbing layer 3 may be added to any helmet described herein.

Figure 7:
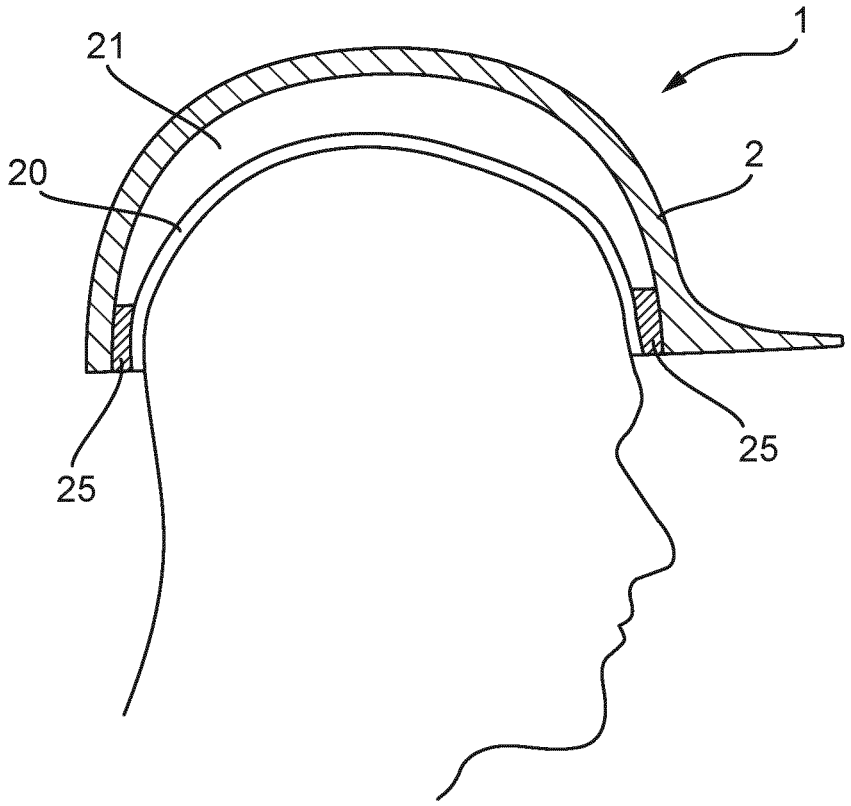
FIG. 7 schematically shows a cross-section through a seventh example helmet.

FIG. 7 schematically depicts a cross-section a helmet of a different type from that depicted in FIGS. 1 to 6. In a helmet 1 such as that depicted in FIG. 7, a head mount 20 is suspended within an outer shell 2 such that an air gap 21 is provided between the outer shell 2 and the head mount 20. Helmets of this type are commonly used for industrial purposes, such as by builders, mine-workers or operators of industrial machinery. However, helmets based on such an arrangement may be used for other purposes. In some uses, the outer shell 2 may be a hard shell made of a polymer material such as polycarbonate (PC), polyvinylchloride (PVC), high density polyethylene (HDPE) or acrylonitrile butadiene styrene (ABS) for example. Advantageously, the polymer material can be fibre-reinforced, using materials such as glass-fibre, Aramid, Twaron, carbon-fibre or Kevlar.

Although the following disclosure relates to an example of a helmet 1 in which the outer shell 2 is formed solely from a hard shell, it should be appreciated that the disclosed arrangement may be applicable to other helmet configurations. For example, the outer shell may alternatively or additionally include a layer of energy absorbing material. Such an energy absorbing material may be made, for example, of a foam material like expanded polystyrene (EPS), expanded polypropylene (EPP), expanded polyurethane (EPU), vinyl nitrile foam; or other materials forming a honeycomb-like structure, or strain rate sensitive foams such as marketed under the brand-names Poron™ and D3O™.

Where used, the layer of energy absorbing material may be provided over substantially all of the surface of the hard shell facing the wearer's head, although ventilation holes may be provided. Alternatively or additionally, localised regions of energy absorbing material may be provided between the hard shell and the head mount. For example, a band of energy absorbing material may be provided around the lower edge of the hard shell and/or a section of energy absorbing material may be provided to be located above the top of the wearer's head.

In a helmet such as that depicted in FIG. 7, the provision of an air gap 21 between the inner surface of the outer shell 2 and the head mount 20 is intended to ensure that loading caused by an impact on the outer shell 2 is spread across a wearer's head. In particular, the load is not localised on a point on the wearer's head adjacent the point of impact on the helmet 1. Instead, the load is spread across the outer shell 2 and, subsequently, spread across the head mount 20 and therefore spread across the wearer's skull.

During such an impact, the energy of the impact may be absorbed by deformation of parts of the helmet, such as the head mount, reducing the size of the air gap. Accordingly, the size of the air gap 21 between the outer shell 2 and the head mount 20 may be chosen to ensure that, under an impact on the helmet that the helmet is designed to withstand, the head mount 20 does not come into contact with the outer shell 2, namely the air gap 21 is not entirely eliminated such that the impact may be directly transferred from the hard shell to the head mount.

In an arrangement, the helmet 1 may be configured such that, in the absence of an impact on the helmet, the separation between the outer shell 2 and the head mount 20 at a location corresponding to the top of the head of a wearer is at least 10 mm, optionally at least 15 mm, optionally at least 20 mm, optionally at least 30 mm, optionally at least 40 mm. The magnitude of the impact that the helmet 1 is designed to withstand, and therefore the size of the air gap 21, may depend upon the intended use of the helmet 1. It should be understood that, depending on the intended use of the helmet, the size of the air gap 21 may be different at different locations. For example, the air gap 21 may be smaller at the front, back or side of the helmet than it is at the location corresponding to the top of the head of the wearer.

In helmet arrangements that include energy absorbing material, the energy absorbing material may contribute to the helmet's ability to withstand radial impacts. In particular in arrangements in which the energy absorbing material is located within the air gap between the outer shell 2 and the head mount 20 at the location corresponding to the top of the wearer's head, it will be appreciated that the gap between the head mount and the surface of the energy absorbing layer will be smaller than the gap between the outer shell and the head mount, and may be eliminated altogether. Additionally, as a result of the energy absorbing material's contribution in the event of a radial impact, a smaller gap between the outer shell and the head mount may be required than would be the case in the absence of the energy absorbing material.

The head mount 20 may be provided in any form that may conform to the head of a wearer, or at least the top of their head, and mount the helmet to the wearer's head or function to contribute to mounting the helmet to the wearer's head. In some configurations, it may assist in securing the helmet 1 to the wearer's head but this is not essential. In some arrangements, the head mount 20 may include a head band, or head ring, that at least partially surrounds the wearer's head. Alternatively or additionally, the head mount 20 may include one or more straps that extend across the top of the wearer's head. Alternatively or additionally, the head mount 20 may include a cap or shell that encapsulates an upper portion of the wearer's head. Straps or bands that form part of the head mount may be formed from Nylon. Other materials may alternatively or additionally be used.

As shown in FIG. 7, the head mount 20 includes a plurality of connectors 25 that are provided between the outer shell 2 and the head mount 20 and are configured to suspend the head mount 20 within the outer shell 2 in order to provide the air gap 21 between the outer shell 2 and the head mount 20. It should be appreciated that, where the head mount 20 is formed from a plurality of sections, such as a head band, straps that extend across the top of the wearer's head and/or a cap or shell, it may be sufficient for one of those components to be attached to the outer shell by the connectors. Alternatively, different elements of the head mount 20 may have respective connectors. In that case, the connectors 25 for different parts of the head mount 20 may be the same or may be different from each other.

Some helmets, such as those shown in FIGS. 1 to 7, are configured to cover a top portion of the head and the above described helmet structures are appropriately located in the helmet to cover a top portion of the head. For example, a helmet may be provided to substantially cover the forehead, top of the head, back of the head and/or temples of the wearer. The helmet may substantially cover the cranium of the wearer.

Figure 8:
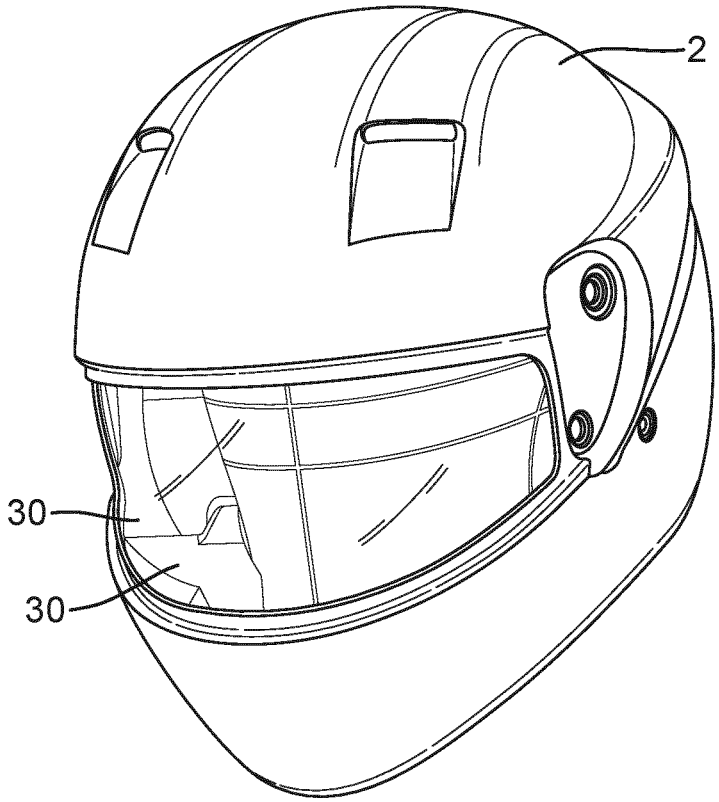
FIG. 8 shows an eighth example helmet.

Some helmets may be configured to cover other parts of the head, alternatively or additionally to a top portion. For example, helmets such as the helmet shown in FIG. 8 may cover the cheeks and/or chin of the wearer. Such helmets may be configured to substantially cover the jaw of the wearer. Helmets of the type shown in FIG. 8, are often referred to as full-face helmets. As shown in FIG. 8, cheek pads 30 may be provided on either side of the helmet 1 (i.e. left and right sides). The cheek pads 30 may be arranged within an outer shell 2 of the helmet 1 to protect the side of the face of the wearer from an impact.

The cheek pads 30 may have the same layered structure as the example helmets described above. For example, the cheek pads 30 may comprise one or more energy absorbing layers as described above, and/or an interface layer as described above, and/or layers that move relative to each other as described above, optionally, layers may be connected by connectors as described above. Alternatively or additionally, the cheek pads 30 themselves may be configured to move relative to the outer shell 2 and, optionally be connected to the outer shell by connectors as described above.

Figure 9:
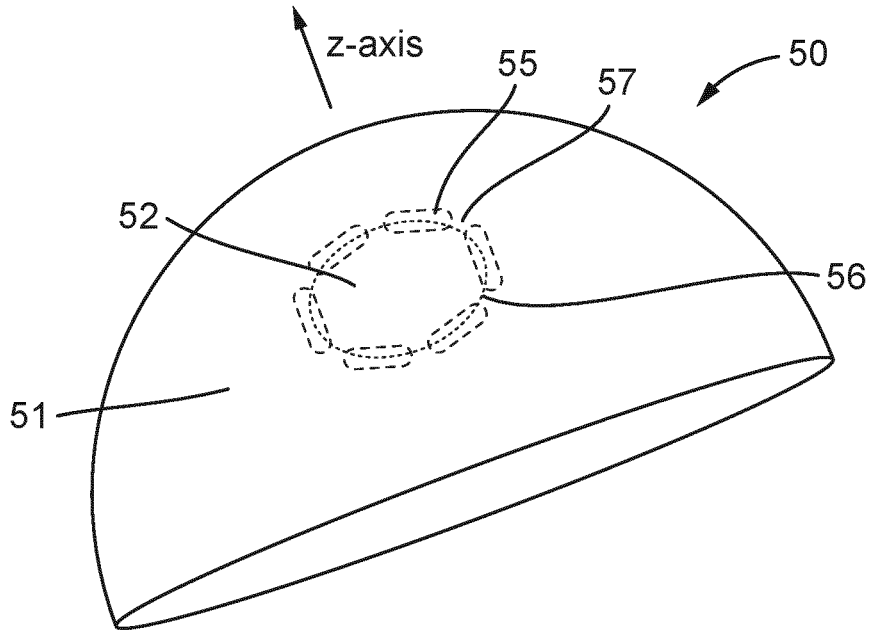
FIG. 9 shows a perspective view of an example shell.

FIG. 9 shows a perspective view of a shell 50. The shell 50 may be used with any of the helmet arrangements described above. In an arrangement, the shell 50 is configured to be detachably attached to the outside of a helmet hard shell 2. When the shell 50 is used with any of the helmet arrangements described above, the outer shells 2 of each of the helmet arrangements is the helmet hard shell 2 to which the shell 50 may be detachably attached.

The shell 50 comprises a plurality of openings 55 arranged along a line on the surface of the shell 50. Each of the plurality of openings 55 extend from a first side to a second side of the shell 50. The first side of the shell 50 may be the outside of the shell 50 and the second side of the shell 50 may be the inside of the shell 50. Each of the plurality of openings 55 therefore extends for the entire depth of the shell 50 between the inner surface and outer surface of the shell 50.

The line along which the plurality of openings 55 are arranged forms a boundary 56 between a first region 51 and a second region 52 of the shell 50. The boundary 56 therefore divides the shell 50 into the respective regions. In an arrangement, the plurality of openings 55 may be arranged around a perimeter of any of the regions 51,52 of the shell 50 such that the plurality of openings 55 enclose the region 51,52. The plurality of openings 55 may therefore define the shape of the region 51,52 enclosed by the plurality of openings 55. The shape of the region 51,52 may be, for example, any one of a circle, ellipse, square, rectangular or other shape. The shape of the region 51,52 may correspond to the shape of a component on the surface of the helmet onto which the shell 50 may be detachably attached. In the example shown in FIG. 9, the plurality of openings 55 define a region 51,52 in the shape of an ellipse.

In an alternative arrangement, the plurality of openings 55 may be arranged along a line which does not enclose a region. In this case, the boundary 56 defined by the plurality of openings 55 does not fully define the shape of either of the regions separated by the boundary. For example, the plurality of openings 55 may be arranged in a line along the curved surface of the shell 50 which extends only partially across the shell 50. Alternately, the plurality of openings 55 may be arranged in a line across the entire shell 50. In this case, the boundary 56 defined by the plurality of openings 55 may divide the shell 50 into different sections. For example, if the plurality of openings 55 extends from the left side to the right side of the shell 50, the boundary 56 defines a front region and a back region of the shell 50. Alternatively, if the plurality of openings 55 extends from the back side to the front side of the shell 50, the boundary 56 defines a left region and a right region of the shell 50.

The region defined by the plurality of openings 55 may be located in various locations of the shell 50. For example, the plurality of openings 55 may define the region 51,52 in one or more of a side, front or back of the shell 50. In the example shown in FIG. 9, the plurality of openings 55 define a region in the side of the shell 50. The sections of the shell 50 are defined with respect to the arrangement of the shell 50 when detachably attached to a helmet 1 being worn by a user. For example, the front region of the shell 50 would correspond to the front region of the user's head. In an arrangement where the helmet covers the cheeks and/or chin of the wearer, the plurality of openings 55 may define a region in the cheek and/or chin region of the shell 50.

In an arrangement, at least one of the plurality of openings 55 is longer in a direction along the boundary 56 than in a direction perpendicular to the boundary 65. This means that at least one of the plurality of openings 55 extends in the direction along the boundary 56. For example, at least one of the plurality of openings 55 may be elongate, optionally substantially a rectangular shape. At least one of the plurality of openings 55 may be a slit. The length of at least one of the plurality of openings 55 in the direction along the boundary 65 may be different to the length of at least one other of the plurality of openings 55 along the boundary 56. In an alternative arrangement, the length of each of the plurality of openings 55 in the direction along the boundary 56 is the same.

The plurality of openings 55 may define a plurality of connecting portions 57 between the first region 51 and the second region 52. Each of the plurality of openings 55 are separated from the other openings 55 along the boundary 56 by the connecting portions 57. The connecting portions 57 are the sections of material of the shell 50 that are present between the openings 55 along the boundary 56. The lengths of each of the connecting portions 57 along the boundary 56 may be less than the lengths of the plurality of openings 55 along the boundary 56. For example, the sum of the lengths of the connecting portions 57 may be less than the sum of the lengths of the plurality of openings 55. The sum of the lengths of the connecting portions 57 may be less than 10% of the sum of the lengths of the plurality of openings 55.

The shell 50 may comprise further pluralities of openings 55 which define further regions of the shell 50. In the case where the shell 50 comprises multiple pluralities of openings each defining a region 51,52 of the shell, the plurality of regions defined by the multiple plurality of openings may be arranged symmetrically around the shell 50.

The shell 50 may be from 0.5 mm to 2.5 mm thick. In an arrangement, the shell 50 is preferably from 1 mm to 1.5 mm thick. The shell 50 may be made of a polymer material such as polycarbonate (PC), polyvinylchloride (PVC), high density polyethylene (HDPE) or acrylonitrile butadiene styrene (ABS).

Figure 10:
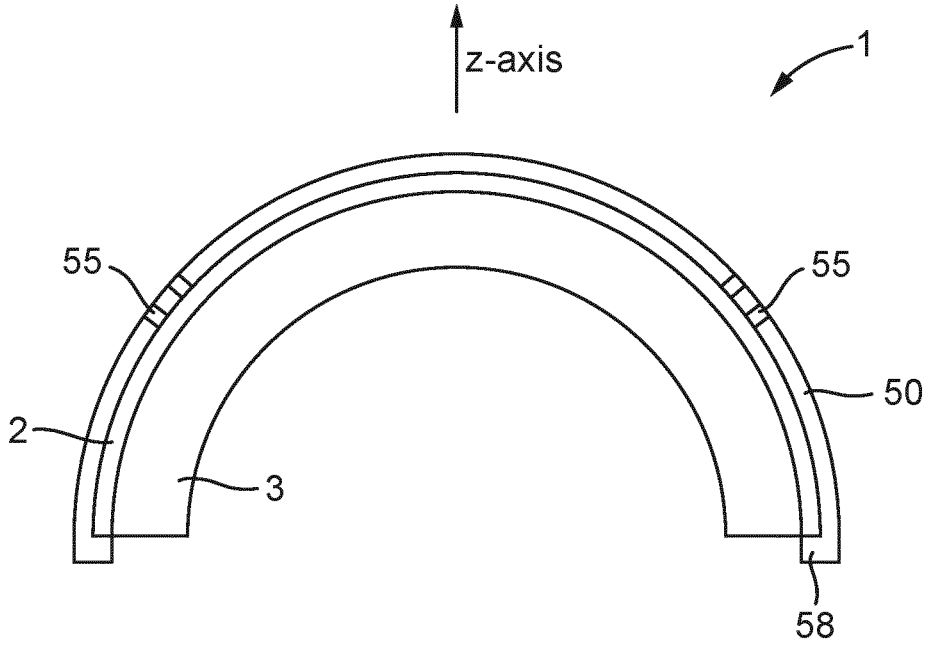
FIG. 10 schematically shows a cross-section through an example helmet and shell.

FIG. 10 shows a schematic cross-section example of the shell 50 attached to the helmet hard shell 2 of a helmet 1. In the example shown in FIG. 10, the helmet 2 further comprises an energy absorbing layer 3 disposed inward of the helmet hard shell 2. In an alternative arrangement, the helmet 1 may not include the energy absorbing layer 3. Other features of the helmet 1 are not shown, but the helmet 1 may further comprise additional layers and/or further components as set out in relation to any of the helmet examples discussed above.

The shell 50 is arranged outwards of the helmet hard shell 2. The shell 50 may be detachably attached to the helmet hard shell 2 of the helmet 1. This means that the shell 50 is attached to the helmet hard shell 2 of the helmet 1 under normal use where an impact is not taking place. However, under forces that are associated with an impact to the shell 50, the shell 50 may detach from the helmet hard shell 2.

The helmet 1 is configured such that the shell 50 is able to move, for example slide, in a tangential direction relative to the helmet hard shell 2 in response to an impact. The shell 50 may move in a tangential direction prior to detaching from the helmet hard shell 2 in response to an impact. In an arrangement, a sliding interface 9 may be provided between the shell 50 and the helmet hard shell 2 of the helmet 1. The sliding interface 9 may take any of the forms as discussed in relation to any of the example helmets above.

The provision of a plurality of openings 55 which define a first 51 and second region 52 of the shell 50 may improve the response of a helmet 1 the shell 50 to an impact. The presence of the openings 55 may allow at least one of the regions 51,52 defined by the boundary to move, for example slide, in a tangential direction relative to each other during an impact on the shell 50 on at least one of the regions 51,52. This relative movement of one region of the shell 50 to another may reduce the effect of an impact on a helmet 1 incorporating the shell 50 to a user of the helmet 1 by reducing the transmission of rotational forces to the brain through absorption of the impact force. The presence of the openings 55 may further facilitate this effect by reducing the average rigidity of the shell 50 in the regions of the openings 55. Arranging the plurality of openings 55 in particular regions of the shell 50 as described above may further facilitate this effect by reducing the average rigidity of the shell 50 around the z-axis of the shell, where the z-axis of the shell is the axis orientated in the vertical direction with respect to the head of a wearer of the helmet 1. For example, the plurality of openings 55 may be arranged in at least the side regions of the shell 50. This arrangement may also reduce the impact force require to detach the shell 50 from the helmet hard shell 2 and/or allow the shell 50 to detach more quickly.

The shell 50 may comprise at least one connector configured for connecting the shell 50 to the helmet 1. The connector may be configured to detachably attach the shell 50 to the helmet hard shell 2 of the helmet 1. The connector may be any one of the example connectors configured to attach first and second parts of a helmet 1 as described above. The connector may detachably attach the shell 50 to the helmet hard shell 2 by any one of an interference connection, a push fit connection and a snap fit connection. The connector may be provided on the lower edge of the shell 50. The connector between the shell 50 and the helmet hard shell 2 may allow relative movement between the shell 50 and the helmet hard shell 2 while connecting the elements of the helmet together.

The connector may be attached to a bottom edge of the helmet hard shell 2. In an alternative arrangement, the connector may be attached to a different edge of the helmet hard shell 2. For example, the surface of the helmet hard shell 2 may comprise a protrusion. In this case, the connector may be attached to the protrusion.

In the example shown in FIG. 10, the shell 50 is detachably attached to the helmet hard shell 2 by a lip portion 58 of the shell 50 which forms an interference fit with the helmet hard shell 2. The lip portion 58 extends over the bottom edge of the helmet hard shell 2. In an arrangement, the lip portion 58 may form an interference fit around the entire periphery of the bottom edge of the helmet hard shell 2. Deformation of the shape of the shell 50 in response to an impact on the shell may cause the lip portion 58 to detach from the bottom edge of the helmet hard shell 2 and thus cause the shell 50 to detach from the helmet 1.

To attach the shell 50 to the helmet 1, the shell 50 may be slid onto the helmet 1. The presence of the lip portion 58 deforms the shape of the shell 50 as it is slid onto the outer shell 2 of the helmet. Once the lip portion passes the bottom edge of the helmet hard shell 2 of the helmet 1, the lip portion 58 snaps into place below the bottom edge of the helmet hard shell 2 and holds the shell 50 in place. In the example arrangement shown in FIG. 9, a gap is present between the shell 50 and the helmet hard shell 2 when the shell 50 is detachably attached to the helmet 1. In an alternative arrangement, the shell 50 may be in contact with the helmet hard shell 2 when the shell 50 is detachably attached to the helmet 1.

The shape of the shell 50 may conform to the shape of the outer surface of the helmet hard shell 2 of the helmet 1. Therefore, any shapes or features formed on the outer surface of the helmet hard shell 2 may also be formed in a corresponding location on the shell 50.

In an arrangement, the rigidity of the material forming the shell 50 may be lower than the rigidity of the material forming the helmet hard shell 2 of the helmet 1. When the rigidity of the material forming the shell 50 is lower than the material of the helmet hard shell 2, the shell 50 may deform more easily in response to an impact while attached to the helmet hard shell 2. This may result in an improved impact response of the helmet 1.

In an alternative arrangement, the rigidity of the material forming the shell 50 may be higher than the rigidity of the material forming the helmet hard shell 2 of the helmet 1. When the rigidity of the material forming the shell 50 is higher than the rigidity of the material forming the helmet hard shell 2, detachment of the shell 50 from the helmet hard shell 2 may take place more quickly in response to an impact. This may result in an improved impact response of the helmet 1.

The preferable rigidity of the material of the shell 50 with respect to the rigidity of the material of the helmet hard shell 2 may depend on other factors such as the shape of the outer surface of the helmet hard shell 2, the thickness of at least one of the shell 50 and the helmet hard shell 2 and the number of openings 55 and/or regions 51, 52 defined by pluralities of openings 55 on the shell 50. Accordingly, the relative strength of the factors promoting a relatively rigid shell 50 or a relatively rigid helmet hard shell 2 may depend on the design of the underlying helmet.

The shell 50 described above may be provided in a kit comprising a shell 50 and a helmet. Alternatively, a helmet may be provided which comprises the shell 50 detachably attached outwards of the helmet hard shell 2 of the helmet.

Figure 11:
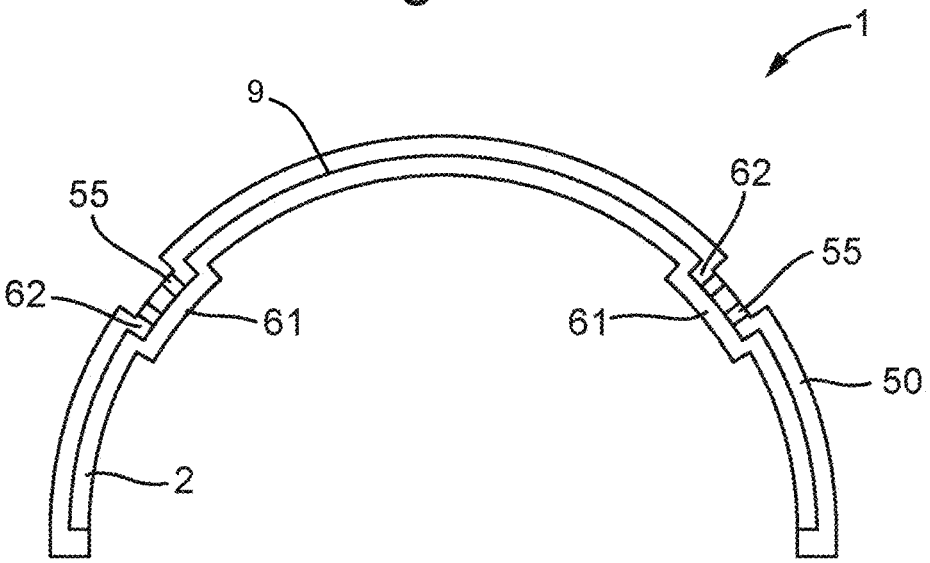
FIG. 11 schematically shows a cross-section through an example helmet with a recess and a shell.

FIG. 11 shows a schematic example of a helmet 1 comprising at least one recess 61 and a shell 50 as described herein. The other components of the helmet 1 are not shown. The example shown in FIG. 11 comprises two recesses 61. The recess 61 is located on the outer surface of the helmet hard shell 2 of the helmet. The helmet hard shell 2 may comprise a plurality of recesses 61. The recess 61 does not extend from the inner side to the outer side of the helmet hard shell 2. In the example shown in FIG. 10, the shape of the shell 50 conforms to the shape of the outer surface of the helmet hard shell 2 of the helmet 1. A corresponding recess 62 is therefore present in a corresponding location in the shell 50. At least one of the plurality of openings 55 may be located in the recess 62 formed in the shell 50. In this arrangement, the at least one of the plurality of openings 55 is therefore located within the recess 61 in the helmet hard shell 2 of the helmet 1. The at least one of the plurality of openings 55 may be located at the periphery of the recess 62.

In an arrangement, a region 51, 52 of the shell 50 defined by the plurality of openings 55 may be located in the recess 62 formed in the shell 50. A plurality of openings 55 located in the recess 62 may define the region of the shell 50 in the recess 62. Because the region of the shell 50 in the recess 62 is set back from the surface defined by the region of the shell 50 not located in the recess 62, such an arrangement may reduce the chance of an impact occurring on to the region located within the recess 62 of the shell. Such an arrangement may improve the impact response of the helmet 1 because the impact is more likely to occur on the larger region. Such an arrangement may also reduce the chance of an impact occurring on one of the plurality of openings 55. The recess 62 of the shell 50 may form an interference fit with the recess 61 of the helmet hard shell 2 to detachably attach the shell 50 to the helmet hard shell 62 as discussed above.

Figure 12:
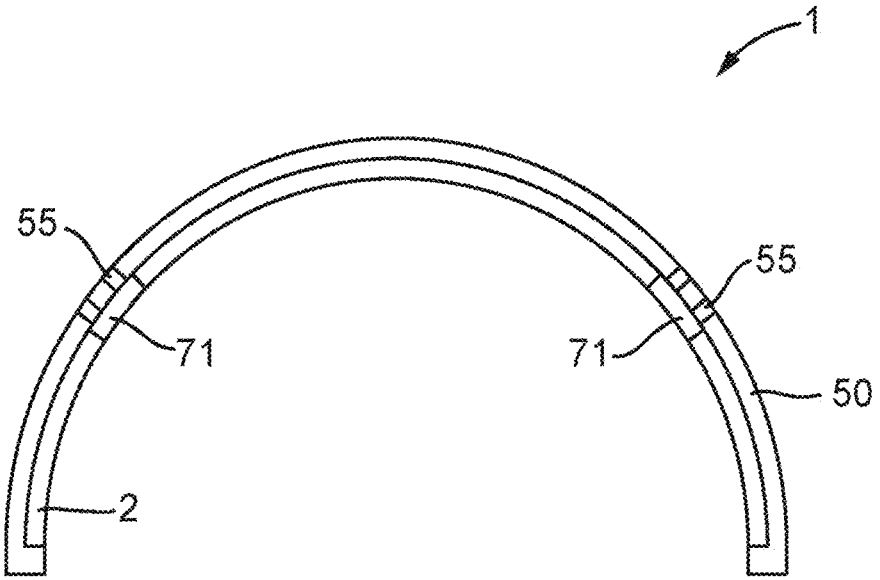
FIG. 12 schematically shows a cross-section through an example helmet with a vent and shell.

FIG. 12 shows a cross-sectional example of a helmet 1 comprising at least one vent 71 and a shell 50 as described herein. The example shown in FIG. 12 comprises two vents 71. The vent 71 is located in the helmet hard shell 2 of the helmet 1. The helmet hard shell 2 may comprise a plurality of vents 71. The vent extends from the inner side to the outer side of the helmet hard shell 2. In an arrangement, at least one of the plurality of openings 55 may be located in the shell 50 such that the at least one of the plurality of openings 55 is located over the vent 71 when the shell 50 is detachably attached to the helmet hard shell 2. In such an arrangement, interference of the shell 50 with the ventilation of the helmet 1 may be reduced or prevented. At least one of the region of the shell 50 defined by the plurality of openings 55 may be located in the shell 50 such that the at least one of the plurality of openings 55 is located over the vent 71 when the shell 50 is detachably attached to the helmet hard shell 2.

The shell 50 as described herein may be manufactured by the following method. In a first step, a shaped layer corresponding to the shape of the shell 50 may be formed, for example using a moulding method such as injection moulding or vacuum moulding. The shaped layer may be monolithically formed from a single material. In a second step, material is removed from the shaped layer to create a plurality of openings 55 in the shaped layer, therefore forming the shell 50 as described herein. The plurality of openings 55 may be formed by cutting or punching material out of the shaped layer. Alternatively, material may be removed by an abrasive method such as drilling or ablation of the material.

In an alternative method, the shell 50 may be manufactured by integrally forming a shell 50, wherein the shell 50 comprises the plurality of openings 55, for example using a moulding method such as injection moulding. The plurality of openings 55 may therefore be defined in the mould used to integrally form the shell 50.

A helmet 1 may be converted into a helmet comprising a shell 50 as discussed herein by forming the shell 50 and attaching the shell 50 to a helmet 1 in a detachable manner as described herein. The step of attaching the shell 50 to the helmet may be performed at a separate location to the manufacture of either the shell 50 or the helmet 1. The shell 50 and helmet 1 may be provided in a kit to facilitate the assembly of the helmet in this manner.

Helmets as described above may be used in various activities. These activities include combat and industrial purposes, such as protective helmets for soldiers and hard-hats or helmets used by builders, mine-workers, or operators of industrial machinery for example. Helmets, are also common in sporting activities. For example, protective helmets may be used in ice hockey, cycling, motorcycling, motor-car racing, skiing, snow-boarding, skating, skate-boarding, equestrian activities, American football, baseball, rugby, soccer, cricket, lacrosse, climbing, golf, airsoft, roller derby and paintballing.

Examples of injuries that may be prevented or mitigated by the helmets described above include Mild Traumatic Brain Injuries (MTBI) such as concussion, and Severe Traumatic Brain Injuries (STBI) such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational component of an impact, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

Variations of the above described examples are possible in light of the above teachings. It is to be understood that the invention may be practiced otherwise and specifically described herein without departing from the spirit and scope of the invention.

The invention claimed is:

1. A helmet comprising a helmet hard shell and a shell configured to be detachably attached to the outside of the helmet hard shell, the shell comprising:

a first region;

a second region; and a plurality of openings, each of the plurality of openings extending from a first side to a second side of the shell; wherein the plurality of openings are arranged along a boundary between the first region and the second region, the shell is arranged outwards of the helmet hard shell such that the shell directly contacts the helmet hard shell under forces associated with an impact, and a sliding interface is provided between the shell and the helmet hard shell;

the shell further comprises a lip portion extending over the edge of the helmet hard shell, wherein the lip portion extending over the edge of the helmet hard shell is configured to detachably attach the shell to the helmet hard shell; and the lip portion extends over the edge of the helmet hard shell around the entire periphery of the helmet hard shell.

2. The helmet of claim 1, wherein the plurality of openings are arranged around a perimeter of the second region such that the plurality of openings enclose the second region.

3. The helmet of claim 1, wherein each of the plurality of openings is longer in a direction along the boundary than in a direction perpendicular to the boundary.

4. The helmet of claim 1, wherein the plurality of openings define a plurality of connecting portions between the first region and the second region; and the sum of the lengths of each of the plurality of openings along the boundary is greater than the sum of the lengths of each of the connecting portions along the boundary.

5. The helmet of claim 1, wherein the second region is arranged in a side region, a front region or a back region of the shell.

6. The helmet of claim 1, further comprising:

a third region; and a further plurality of openings, each of the further plurality of openings extending from the first side to the second side of the shell; wherein the plurality of openings are arranged along a boundary between the first region and the third region.

7. The helmet of claim 1, wherein the shell is from 0.5 mm to 2.5 mm thick.

8. The helmet of claim 1, further comprising at least one connector for connecting the shell to the helmet; wherein said connector is provided on the lower edge of the shell.

9. A kit comprising a shell according to claim 1 and a helmet; wherein the shell is configured to be attached to the helmet to form the helmet according to claim 1.

10. The helmet of claim 1, wherein the shell is detachably attached to an edge of the helmet hard shell; wherein the edge is the bottom edge of the helmet hard shell.

11. The helmet of claim 1, wherein the shape of the shell conforms to the shape of an outer surface of the helmet hard shell.

12. The helmet of claim 1, wherein the rigidity of the material forming the helmet hard shell is lower than the material forming the shell.

13. The helmet of claim 1, wherein the rigidity of the material forming the helmet hard shell is higher than the material forming the shell.

14. The helmet of claim 1, wherein a periphery of the shell is detachably connected to a periphery of the helmet hard shell by at least one of an interference connection, a push fit connection, and a snap fit connection.

15. The helmet of claim 1, wherein the helmet hard shell comprises a recess on the outer surface of the helmet hard shell; and the second region is located within the recess.

16. The helmet of claim 1, wherein the helmet hard shell comprises a vent; and at least one of the plurality of openings and/or the second region is located over the vent; wherein, optionally, the helmet further comprises an energy absorbing layer disposed inward of the helmet hard shell.

* * * * *